US006676508B1

(12) United States Patent
Graham

(10) Patent No.: US 6,676,508 B1
(45) Date of Patent: Jan. 13, 2004

(54) MAGNETICALLY CONTROLLED FLOW SYSTEM

(76) Inventor: Gerald Graham, P.O. Box 98, Kleinburg, Ontario (CA), L0J 1C0

( * ) Notice: Subject to any disclaimer, the term of this patent is extended or adjusted under 35 U.S.C. 154(b) by 0 days.

(21) Appl. No.: 10/420,367

(22) Filed: Apr. 22, 2003

(51) Int. Cl.[7] ..... F24F 7/00
(52) U.S. Cl. ..... 454/270; 454/904; 454/69
(58) Field of Search ..... 454/904, 270, 454/256, 69; 137/75

(56) References Cited

U.S. PATENT DOCUMENTS 2,739,521 A * 3/1956 Spear ..... 454/349
4,394,958 A 7/1983 Whitney et al.
4,452,391 A * 6/1984 Chow ..... 236/49.3
4,512,356 A * 4/1985 Widerby ..... 137/75
4,545,363 A * 10/1985 Barchechat et al. .... 126/285 B
4,580,486 A 4/1986 Schulz
4,693,175 A * 9/1987 Hashimoto ..... 454/187
4,715,268 A 12/1987 Tanner
4,942,348 A 7/1990 Nilssen
5,167,574 A 12/1992 Ikeda et al.
5,433,660 A 7/1995 Ohba
5,716,271 A * 2/1998 Paidosh ..... 454/359
6,149,516 A * 11/2000 Mantyla ..... 454/359
6,192,922 B1 * 2/2001 MacGibbon et al. ..... 137/486

* cited by examiner

*Primary Examiner*—Derek Boles
(74) *Attorney, Agent, or Firm*—Young & Basile P.C.

(57) ABSTRACT

A magnetically controlled flow system having a pivotable flap with a permanent magnet at distal ends. Two coils with magnetizable cores are mounted inside the duct and positioned so as to cooperate with the permanent magnet when the flap is in either a closed or an open position. By energizing the coils, the permanent magnet is attracted to the magnetizable cores in either one of the coils, thereby actuating the flap between the closed and open positions.

20 Claims, 2 Drawing Sheets

MAGNETICALLY CONTROLLED FLOW SYSTEM

FIELD OF THE INVENTION

The present invention relates generally to fluid flow systems, and more particularly to a controllable fluid flow system for regulating the flow of air through a ventilation system.

BACKGROUND OF THE INVENTION

Ventilation systems control the temperature and quality of air in an enclosed area such as a building. This is typically achieved by heating or cooling air by a centralized air conditioning unit then forcing the thermally conditioned air through a plurality of interconnected air carriers leading to various sections of the building. Ideally, the air carriers or ducts are configured and arranged to allow uniform distribution of forced air to maintain a desirable temperature setting throughout different areas of the building.

A properly balanced ventilation system results in lower operating costs and significant utilities conservation. However, due to structural restrictions, the air ducts must be bent and re-routed in order to reach the various areas of the building. Such deviations cause unpredictable flow impedance through the air ducts, thereby resulting in disparities in the optimal temperature level in various zones of the building.

Aside from the temperature imbalances caused by non-uniform distribution of thermally conditioned air, it may be required to individually control the temperature in various areas of a building. In modem buildings having various zones designed for variable functions and changing occupancy, it may be desirable to maintain a distinct temperature level in different zones. The conventional single source ventilation system connected to a centralized duct distribution network is not capable to provide variable flow impedance in different areas of the building.

One way of addressing the foregoing problems is to provide separate ventilation systems for individual areas of the building. Such solution is not economically feasible and requires extensive duct installation and isolation. Furthermore, the installation of such system results in waste of real estate dedicated to the individual ventilation systems.

Another possible solution to maintain desirable temperature balance in various parts of a building is to regulate the amount of forced air released from the ducts. Conventional ventilation systems often employ adjustable dampers incorporated into the exhaust end of air ducts to control the amount of forced air distributed to an area of the building. These dampers regulate the amount of air flowing through the respective ducts by adjusting the degree that the dampers open. The dampers may be manually adjusted to regulate the air flow, gravity or air flow actuated, or could be actuated by means of electric motors or solenoid actuators. See for example U.S. Pat. No. 5,433,660 issued Jul. 18, 1995 to Ohba. However, there are a number of drawbacks associated with the prior systems. Manual adjustment of the dampers is cumbersome since the ducts are typically located in inaccessible areas. Although the motor operated dampers can be thermostatically controlled, they are not an optimal implementation of a flow regulation system as they are expensive, consume energy, and are prone to breaking down. Moreover, it may be difficult to find a replacement motor if the motor has been discontinued. As for the solenoid actuators, they generally operate in cooperation with gravity, air pressure or the bias of a spring to actuate the damper. This is quite inefficient as the damper's action is not in response to changes in the temperature.

BRIEF SUMMARY OF THE INVENTION

The present invention provides a symmetrical magnetically controlled flow system for regulating the flow of thermally conditioned air in a multiduct ventilation system which addresses the shortcomings associated with known systems.

The present invention arises from the realization that the existing adjustable dampers used for regulating the distribution of thermally conditioned air to various zones of a building are inefficient, difficult to adjust and expensive to maintain and operate. To alleviate these problems, the present invention provides a magnetically controlled flap incorporated in the exhaust end of an air duct having a magnetically attractive member located thereon. Two coils with magnetizable cores are mounted inside the air duct and positioned so as to cooperatively bias the magnetically attractive member when the flap is in either a closed or an open position. By energizing the coils, the magnetically attractive member becomes attracted to the magnetizable cores in either coil, thereby actuating the flap between the closed and open positions. The coils' action may be managed by a controller sensitive to changes in the ambient temperature.

In a first aspect, the present invention provides a device for controlling the flow of a fluid through a flow passage defined by a conduit, including a flap for mounting in the conduit for movement between a first position and a second position, the flap restricting the flow of the fluid in the conduit more in the second position than in the first position. A magnet is mounted on the flap. The device further includes a stationary first electromagnet for acting on the magnet to bias the flap towards the first position when energized and a stationary second electromagnet for acting on the magnet to bias the flap towards the second position when energized In another aspect, the present invention provides a magnetically controlled flow system comprising: (a) a conduit for carrying the flow of thermally conditioned fluid to an enclosure; (b) blocking means movably disposed in the conduit and are selectively operable in an open position allowing flow of fluid, or a closed position blocking the flow of fluid therethrough; (c) a magnetically attractive member disposed on the blocking means; (d) a first latch means for acting on the magnetically attractive means to cause the blocking means to move to an open position; and (d) a second latch means for acting on the magnetically attractive means to cause the blocking means to move to a closed position.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings, which show, by way of example, a preferred embodiment of the present invention, and in which:

FIG. 4(*b*) is a side elevational view of FIG. 1 when the magnetically controlled flow system is in the open position.

DETAILED DESCRIPTION OF THE INVENTION

Figure 1:
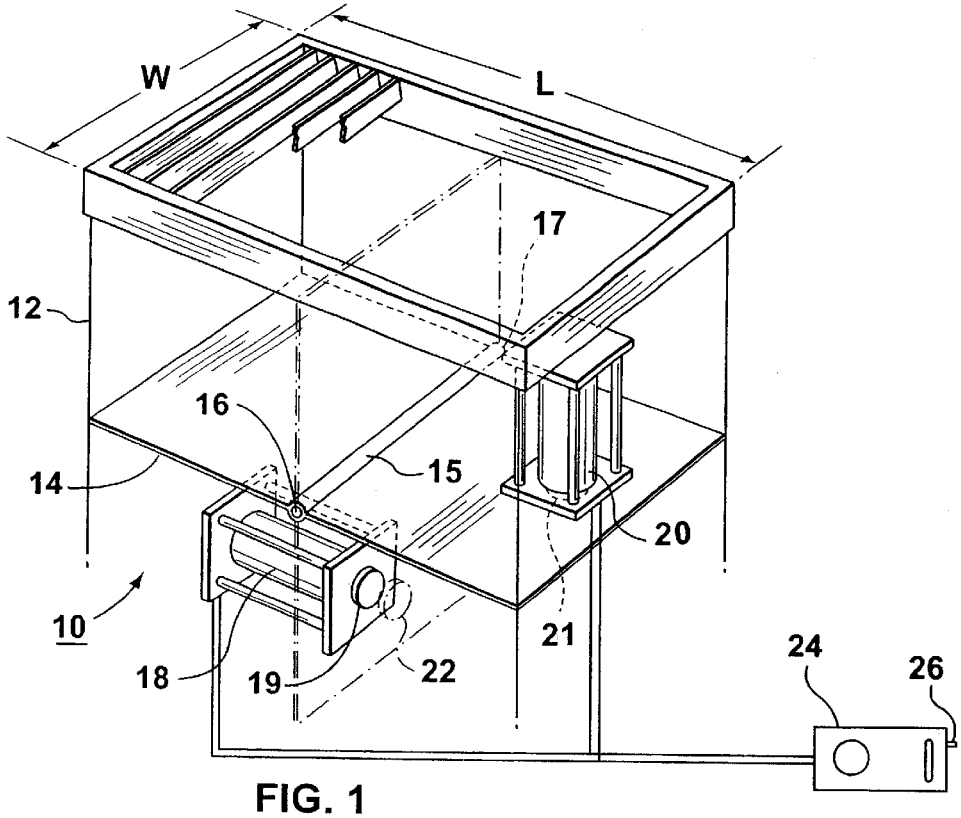
FIG. 1 is a perspective view of a magnetically controlled flow system according to an embodiment of the present invention.

The present invention is now described with reference to accompanying drawings, wherein like constituent elements are designated by like reference numerals throughout the drawings.

Reference is now made to FIG. 1, which shows a magnetically controlled flow system 10 according to an embodiment of the present invention. Incorporated into a the exhaust end of a ventilation duct 12 is a free-swinging flap 14 which is pivotably supported about a pivot axis 15 by oppositely disposed pin hinge assemblies 16, 17. The duct 12 has a rectangular cross-section with a longer length "L" than width "W", and the pivot axis 15 extends across the width of the duct 15. The flap 14 may be made of sheet metal, hard plastic or similarly rigid materials.

A pair of electromagnetic coils 18, 20 mounted onto the inner walls of the duct 12 actuate the flap 14 in a closed (as shown by solid lines) or open (as indicated by dotted lines) position by attracting or repulsing a magnetically attractive member such as a magnet 22 disposed on the flap 14. The coils 18, 20 each include a magnetizable core 19, 21 disposed therein and are positioned on the inner walls of the duct 12 such that the magnet 22 abuts against and is attracted to the magnetizable core 19 or 21 in the open or closed positions respectively. A controller 24 having a power source (not shown) is coupled to coils 18, 20 and controls the flow of electric current pulses through the coils 18, 20 in order to manage the opening or closing action of the flap 14. When the flap. 14 is in the closed position, the magnet 22 is attracted to the magnetizable core 21, thereby maintaining the flap 14 in the closed position to block the flow of fluid through the duct 12. In one embodiment, the flap 14 is moved into the open position by sending a current pulse through the coils 18, 20 such that the magnet 22 is repulsed by the coil 20 and attracted to by coil 1 8. Attraction of the magnet 22 to the core 19 then serves to hold the flap 14 in the open position. Preferably, the pivot axis 15 extends across the centre of the flap 14 such that the flap 14 is balanced and the effect of the gravity on biasing rotation of the flap 14 is minimal.

The magnet 22 is a permanently magnetic material such as a ferromagnetic material, and is mounted on the flap 14 with oppositely facing poles such that it comes into intimate contact with the magnetizable cores 19, 21 in the open or closed positions respectively. The magnetizable cores 19, 21 are preferably made from steel, or other magnetizable ferrous materials.

Advantageously, the controller 24 may be equipped with a thermostat 26 to control the action of the flap 14 in response to changes in the ambient temperature. The thermostat 26 monitors the temperature of a zone of the building requiring temperature control and reports changes in the ambient temperature to the controller 24. The controller 24 adjusts the ambient temperature to a desired level by actuating the flap 14 based on the state of the thermostat 26.

Figure 2:
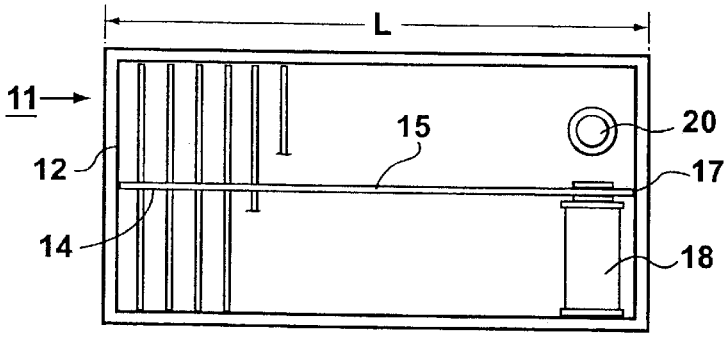
FIG. 2 is a schematic view of a magnetically controlled flow system according to another embodiment of the present invention.

There is shown in FIG. 2 a magnetically controlled flow system 11 that is generally similar to the magnetically controlled flow system 10 of FIG. 1, except that the pivot axis 15 of the flap 14 (shown in the open position) extends across the length of the duct 12, rather than its width. Such a configuration requires less force to move the flap 14 compared to the configuration of FIG. 1. The coils 18, 20 are positioned to interact with magnet 22 located a distal end of the flap 14 so as to retain the flap 14 in the open or closed position.

Figure 3:
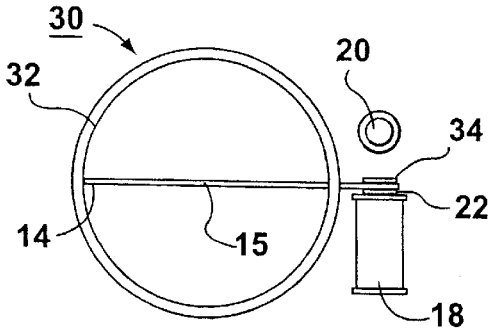
FIG. 3 is a schematic view of a magnetically controlled flow system according to yet another embodiment of the present invention.

FIG. 3 illustrates a magnetically controlled flow system 30 in accordance with the present invention installed in a duct 32 of a circular cross section. The duct 32 could be of any length or diameter and may be part of a continuous ductwork of larger length or diameter. As shown in FIG. 3, the flap 14 includes an extension 34 extending from flap 14 to an area outside of the duct 12. The extension 34 may be in a plane substantially parallel to the plane of flap 14 as illustrated in FIG. 3, or in a perpendicular or other plane depending upon the positioning of the coils 18, 20. The extension 34 includes a magnet 22 which works in cooperation with the coils 18, 20 located outside of the duct 12 to assist in the opening and closing action of flap 14 as per the teaching of the invention.

Figure 4A:
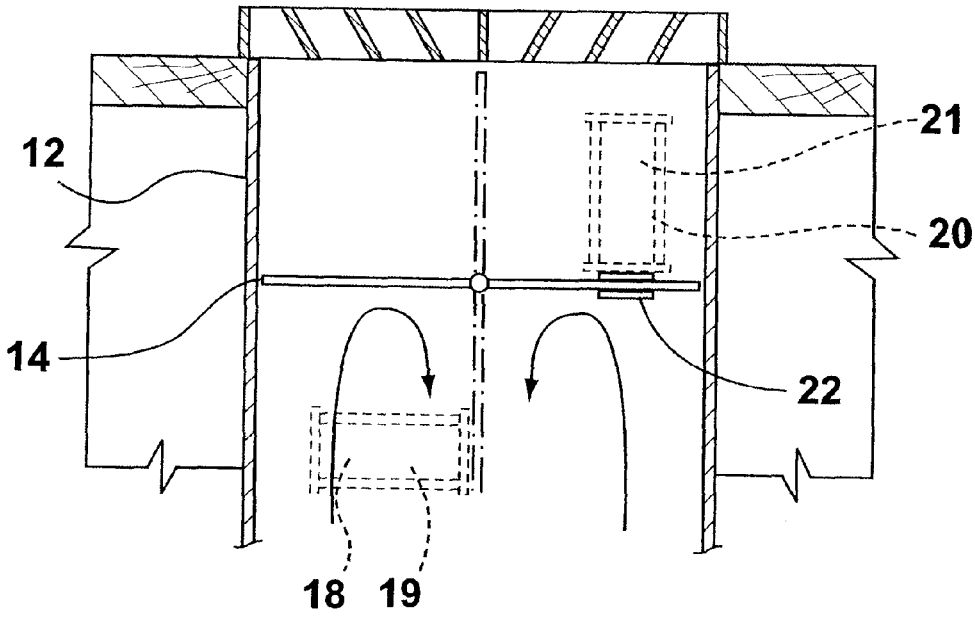
FIG. 4(*a*) is a side elevational view of FIG. 1 when the magnetically controlled flow system is in the closed position.
Figure 4B:
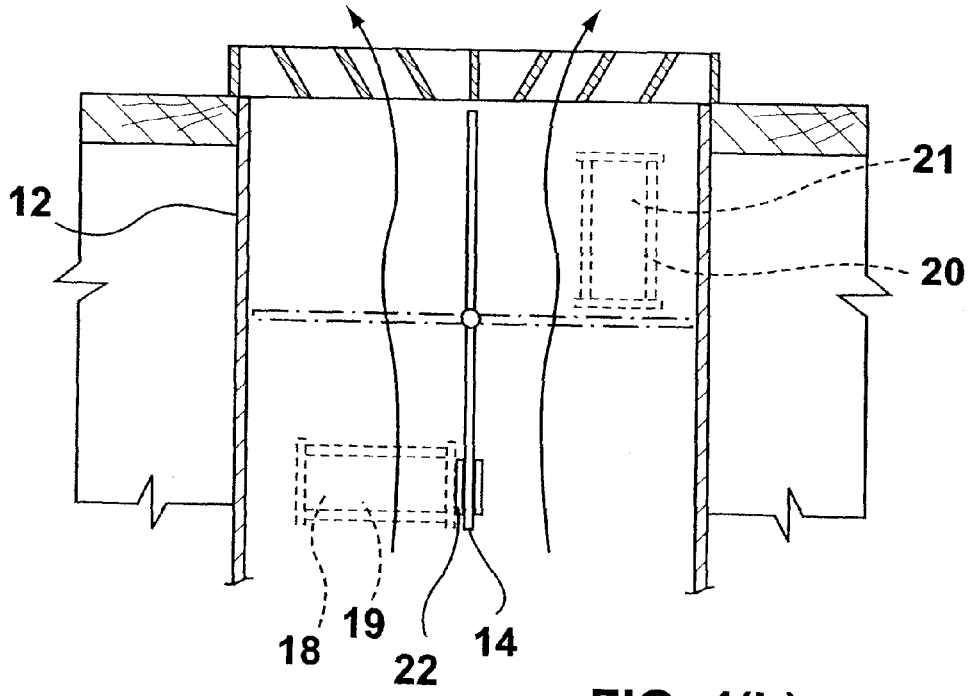

Referring now to FIGS. 4(*a*) and 4(*b*), the magnetically controlled flow system of FIG. 1 is shown in the closed and open positions respectively. To move the flap 14 from an open position shown in FIG. 4(*b*) to a closed position shown in FIG. 4(*a*), coils 18, 20 are energized by a current pulse so as to respectively repel and attract the magnet 22. As a result, the magnet 22 moves towards the magnetizable core 21 of coil 20 to the closed position by reason of the attractive magnetic force exerted thereupon by the magnetizable core 21 and the repulsive magnetic force of the magnetizable core 19 (as shown in FIG. 1).

To move the flap 14 into the open position as illustrated in FIG. 4(*b*), the coil 18 is energized such that it attracts the magnet 22, and coil 20 is energized so as to repel the magnet 22, causing the flap 14 to pivot to the open position allowing fluid to pass through the duct 12. In a preferred embodiment of the invention, the coils 18, 20 are only energized momentarily and when it is necessary to move the flap 14 from one position to another. The flap 14 is then retained in either the open or closed position by the attraction of the magnet 22 to the non-energized steel core 21 in the closed position and by the attraction of the permanent magnet 22 to the steel core 19 in the open position. Accordingly, the coils 18, 20 need only be energized to move the flap but are otherwise not energized.

In another embodiment of the present invention, when it is desired to move the flap 14, only the coil 18 or 20 that the flap 14 is presently attached to is energized so as to repel the magnet 22 towards the other de-energized coil 18 or 20. For instance, when the flap 14 is in the closed position, coil 20 is energized so as to repel the magnet 22 towards the coil 18 (which remains de-energized). Magnet 22 magnetically attaches to the steel core 19 of coil 18 to retain the flap 14 in the open position. To move the flap 14 back to the closed position, the coil 18 is energized to repel the magnet 22 towards coil 20 (which remains de-energized). Magnet 22 then magnetically attaches to the steel core 21 of coil 20 to maintain the flap 14 in the closed position. Such a configuration can be simpler than energizing both coils at once to respectively attract and repel the magnet 22 as coil 18, 20 has to be configured to repel the magnet 22.

It will be noted that coil 20 and coil 18 act as stop members against which flap 14 rests when in the closed and open positions, respectively.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A device for controlling the flow of a fluid through a flow passage defined by a conduit, comprising:

a flap for mounting in the conduit for movement between a first position and a second position, the flap restricting the flow of the fluid in the conduit more in the second position than in the first position;

a magnet mounted for movement with the flap;

a stationary first electromagnet for acting on the magnet to bias the flap towards the first position when energized; and a stationary second electromagnet for acting on the magnet to bias the flap towards the second position when energized.

2. The device as set forth in claim 1, wherein in the first position the magnet is located in the proximity of the second electromagnet with a magnetic attraction of the magnet to a core of the second electromagnet biasing the flap in the first position, and in the second position the magnet is located in the proximity of the first electromagnet with a magnetic attraction of the magnet to a core of the first electromagnetic biasing the flap in the second position.

3. The device as set forth in claim 1, wherein the first and second electromagnets are magnetizable.

4. The device as set forth in claim 1, wherein the first and second electromagnets are mounted on inner walls of the conduit.

5. The device as set forth in claim 1, wherein the flap is formed from a rigid material.

6. The device as set forth in claim 1, wherein the flap is pivotably mounted inside the conduit for pivoting about a pivot axis.

7. The device as set forth in claim 1, wherein the flap is generally held in a balanced position about the pivot axis.

8. The device as set forth in claim 1 further comprising a controller having a thermostat coupled to the first and second electromagnets to control the magnetization of the first and second electromagnets to open and close the flap in response to changes in temperature sensed by the thermostat.

9. The device as set forth in claim 1, wherein the flap is a rectangular plate for use with a conduit having a rectangular cross section.

10. The device as set forth in claim 1, wherein the flap is a circular plate for use with a conduit having a circular cross section.

11. The device as set forth in claim 1, wherein the flap includes an extension for extending outside of the conduit, the magnet being mounted on an extending area of the extension.

12. A magnetically controlled flow system comprising:

a conduit for carrying the flow of thermally conditioned fluid to an enclosure;

blocking means movably disposed in the conduit and selectively operable in an open position allowing flow of fluid, or a closed position blocking the flow of fluid therethrough;

a magnetically attractive member disposed on the blocking means;

a first latch means for acting on the magnetically attractive means to cause the blocking means to move to an open position; and a second latch means for acting on the magnetically attractive means to cause the blocking means to move to a closed position.

13. The magnetically controlled flow system as set forth in claim 12, wherein the first and second latch means comprise coils generating a magnetic force in response to a current passing therethrough.

14. The magnetically controlled flow system as set forth in claim 12, wherein the magnetically attractive member is a permanent magnet.

15. The magnetically controlled flow system as set forth in claim 12, wherein the blocking means is a rectangular plate for use with a conduit having a rectangular cross section.

16. The magnetically controlled flow system as set forth in claim 12, wherein the blocking means is a circular plate for use with a conduit having a circular cross section.

17. The magnetically controlled flow system as set forth in claim 12, wherein the first latch means is selectively operable between a first energized state attracting the magnetically attractive member such that the blocking means come into intimate contact with the first latch means to hold the blocking means in the closed position, and a second energized state repelling the magnetically attractive member so as to hold the blocking means in the open position.

18. The magnetically controlled flow system as set forth in claim 12, wherein the second latch means is selectively operable between a first energized state repelling the magnetically attractive member so as to hold the blocking means in the open position, and a second energized state attracting the magnetically attractive member such that the blocking means come into intimate contact with the first latch means to hold the blocking means in the closed position.

19. The magnetically controlled flow system as set forth in claim 12 further comprising control means operatively connected to the first and second latch means for actuating the blocking means between the open and closed position.

20. The magnetically controlled flow system as set forth in claim 19, wherein the control means further comprises thermostat means for monitoring a temperature of the enclosure and directing the control means to energize the first and second latch means based on the temperature of the enclosure as determined by the thermostat means.

* * * * *